US006706224B2

(12) United States Patent
Firgo et al.

(10) Patent No.: US 6,706,224 B2
(45) Date of Patent: Mar. 16, 2004

(54) PROCESS AND DEVICE FOR THE PRODUCTION OF CELLULOSIC MOULDED BODIES

(75) Inventors: Heinrich Firgo, Vöcklabruck (AT); Rudolf Kraft, Wels (AT); Harmut Rüf, Vöcklabruck (AT); Christian Schlossnikl, Vöcklabruck (AT)

(73) Assignee: Lenzing Aktiengesellschaft, Lenzing (AT)

( * ) Notice: Subject to any disclaimer, the term of this patent is extended or adjusted under 35 U.S.C. 154(b) by 275 days.

(21) Appl. No.: 09/768,324

(22) Filed: Jan. 24, 2001

(65) Prior Publication Data

US 2002/0046799 A1 Apr. 25, 2002

Related U.S. Application Data

(63) Continuation of application No. PCT/AT99/00141, filed on Jun. 4, 1999.

(30) Foreign Application Priority Data

Jul. 28, 1998 (AT) ..... 1294/98

(51) Int. Cl.[7] ..... D01D 5/06; D01F 2/02; D04H 3/02

(52) U.S. Cl. ..... 264/103; 264/187; 264/203; 264/211.12; 264/211.14; 264/211.16

(58) Field of Search ..... 264/187, 203, 264/211.12, 211.14, 211.16

(56) References Cited

U.S. PATENT DOCUMENTS 4,246,221 A 1/1981 McCorsley, III ..... 264/203

FOREIGN PATENT DOCUMENTS

| | | |
|---|---|---|
| DE | 1760431 | 12/1971 |
| EP | 0617150 A1 | 9/1994 |
| EP | 0553070 B1 | 10/1996 |
| GB | 790039 | 1/1958 |
| WO | 9319230 A1 | 9/1993 |
| WO | 9428210 A1 | 12/1994 |
| WO | 9724476 A1 | 7/1997 |
| WO | 9807911 A1 | 2/1998 |

OTHER PUBLICATIONS

English abstract of EP 0 553 070B1 (Oct. 23, 1996).
English abstract of DE 1 760 431 (Dec. 23, 1971).
English abstract of WO 97/24476A1 (Jul. 10, 1997).

*Primary Examiner*—Leo D. Tentoni
(74) *Attorney, Agent, or Firm*—Baker Botts LLP

(57) ABSTRACT

The invention relates to a process for the production of a spunlaid fabric containing solvent-spun cellulosic fibers. The process is characterised in that a solution of cellulose in an aqueous tertiary amine oxide is extruded through a spinneret (1) with orifices and the extruded filaments (3) are stretched in an air gap and led into a precipitation bath (2), the filaments in the precipitation bath (2) are intercepted by a first conveyor device (5) whereby a curtain of threads of filaments basically arranged parallel to each other and basically of constant thickness is formed on the first conveyor device (5), the curtain of threads is transported by means of the first conveyor device (5) out of the precipitation bath (2) onto a second conveyor device inclined downwards (8), and the curtain of threads is transported downwards on the second conveyor device (8) onto a third conveyor device (10), where the third conveyor device (10) draws off the curtain of threads at a speed less than the speed of the curtain of threads transported downwards on the second conveyor device.

13 Claims, 4 Drawing Sheets

PROCESS AND DEVICE FOR THE PRODUCTION OF CELLULOSIC MOULDED BODIES

This is a continuation of copending application Serial No. PCT/AT99/00141 filed Jun. 4, 1999, which is incorporated by reference herein. PCT/AT99/00141, filed Jun. 4, 1999 was not published in English.

The invention relates to a process and a device for the production of cellulosic molded bodies, in particular to the production of a spunlaid fabric containing solvent-spun fibres. Moreover, the invention relates to a spunlaid fabric obtainable by the process in accordance with the invention.

BACKGROUND OF THE INVENTION

In the last few decades intensive efforts were undertaken to produce alternative environmentally-friendly processes for the production of cellulosic fibres as a result of the environmental problems associated with the well-known viscose process. One of the most interesting possibilities to emerge in the recent past was to dissolve cellulose in an organic solvent without the formation of a derivative and to extrude moulded bodies from this solution. Fibres spun from solutions of this kind were given the generic name of Lyocell by BISFA (The International Bureau for the Standardization of Man-Made Fibres) whereby an organic solvent means a mixture of an organic chemical and water. Moreover, fibres of this kind are known as "solvent-spun fibres".

It has turned out that a mixture of a tertiary amine oxide and water is particularly well suited as the organic solvent for the production of Lyocell fibres respectively other moulded bodies N-methyl-morpholine-N-oxide (NMMO) is thereby mainly used as the amine oxide. Other suitable amine oxides are disclosed in EP-A O 553 070. When the expression "NMMO" is used in the following this means all the amine oxides suitable to dissolve the cellulose. The process for the production of cellulosic moulded bodies from solutions of cellulose in NMMO is described as the "amine oxide process".

Processes for the production of cellulosic molded bodies from a solution of cellulose in a mixture of NMMO and water are for example disclosed in U.S. Pat. No. 4,246,221 or PCT-WO 93/19230. In this respect the cellulose is precipitated from the solution in an aqueous precipitation bath. Fibres manufactured in this way are characterised by a high fibre tenacity in a conditioned and wet state, a high wet modulus and a high loop strength. The term "spunlaid fabrics" relates to fabrics which are made into a fabric by laying freshly spun continuous filaments. Spunlaid fabrics from cellulosic fibres are well known.

For example DE 17 60 431 describes a process in which a tow of continuous filaments freshly spun according to the viscose process with a titre of 0.1 to 10 den is transported on a slide with a 4° to 15° downhill angle and is treated on this slide using rays of water undulating vertical to the running direction. This treatment has as its object that the filaments are opened under the effect of water penetration, i.e. are arranged parallel to each other. The filaments arranged in parallel fashion are led to a screen belt the speed of which is lower than the speed of the continuous filament approaching. This leads to the formation of the spunlaid fabric.

In a talk given at the conference "Cellulosic Man-Made Fibres" in Singapore, April 1997, K. Nishiyama describes a process for the production of a spunlaid fabric according to the so-called "Bemliese" process. In the "Bemliese" process the cellulose is dissolved in a mixture of cupric sulphate and ammonia. The filaments spun from this solution are brought onto a conveyor belt vibrating diagonal to the transport direction by means of which the spunlaid fabric is formed. The formed web is strengthened with jets of water.

One disadvantage of the process described above is that moved parts are needed in each case for the formation of the fabric and/or the opening of the filaments. This means that more is required in terms of apparatus.

With regard to the amine oxide process it is known from WO 97/24476 to lay hydraulically stretched continuous cellulose filaments to a fabric and to bond this.

WO 97/01660 describes amongst other things the production of a mixture of cellulosic fibres and microfibres in accordance with the amine oxide process whereby the fibres manufactured are laid to a web. However, this relates to non continuous fibres.

WO 98/07911 describes a process for the production of Lyocell fibres whereby the freshly spun, partly continuous filaments are amongst other things stretched using an air stream and laid to a web. Stretching using an air stream is, however, complicated.

In these well known processes the formation of the spunlaid fabric takes place the first time that the spun filaments are laid. In cases like this it is difficult to deliberately influence the properties of the spunlaid fabric produced in this way via subsequent treatments.

SUMMARY OF THE INVENTION

The present invention sets itself the task of making a process and a device available for the production of spunlaid fabrics in accordance with the amine oxide process which overcomes the disadvantages of the well know processes for the production of spunlaid fabrics both according to the amine oxide process and according to the viscose or "Bemliese" processes.

This task is resolved by a process characterised in that a solution of cellulose is extruded in an aqueous tertiary amine oxide via a spinneret with orifices and the extruded filaments are stretched in an air gap and led into a precipitation bath, the filaments in the precipitation bath are intercepted by a first conveyor device whereby a curtain of threads of filaments basically oriented parallel to each other and basically of constant thickness is formed on the first conveyor device, the curtain of threads is transported out of the precipitation bath using the first conveyor device onto a second conveyor device inclined downhill and the curtain of threads is transported downwards on the second conveyor device onto a third conveyor device where the third conveyor device draws off the curtain of threads at a speed less than the speed of the curtain of threads transported downwards on the second conveyor device.

With the process in accordance with the invention it becomes possible to produce spunlaid fabrics according to the amine oxide process with a wide spectrum of properties.

In the process in accordance with the invention the solution of cellulose in NMMO is first of all extruded using a spinneret with orifices. In this respect it is important that when laying the spun continuous filaments on a first conveyor device a curtain of threads is formed of basically parallel oriented filaments and basically of constant thickness.

This can for example be achieved in that the filaments are extruded from a spinneret the orifices of which are as the case may be arranged in a staggered form one behind the other in parallel rows and basically form altogether a rectangle. Spinnerets of this kind are for example known from PCT-WO 94/28210. When filaments spun from a spinneret of this kind are placed on a conveyor device a curtain of threads occurs in which the filaments are generally arranged parallel to one another. Moreover, the thickness of this curtain of threads is basically constant across the width of the curtain of threads. This allows for more even spunlaid fabric properties.

For the expert it is easy to find other spinneret constructions in which following extrusion and lying down onto the first conveyor device a curtain of threads is formed with the desired properties.

This curtain of threads is led to a second conveyor device inclined downwards on which the curtain of threads is transported downwards to a third conveyor device. Since the curtain of threads is comprised basically of filaments lying parallel one to the other, an opening of the curtain of threads using moved parts, as is described in DE 17 60 431, is no longer necessary.

The formation of the spunlaid fabric is performed, as it is known from DE 17 60 431, when transferring the curtain of threads from the second to the third conveyor device, since the curtain of threads is led to the third conveyor device at a greater speed than the speed with which the third conveyor device removes the curtain of threads.

In the process in accordance with the invention the formation of the spunlaid fabric does not take place when the spun filaments are piled down for the first time, as is known from PCT WO 98/07911 or the "Bemliese" process. This has the advantage that the curtain of threads comprising basically filaments arranged in parallel fashion can be treated in different ways up to the formation of the spunlaid fabric. In this way it becomes possible to treat the individual filaments in an even manner and spunlaid fabrics can be manufactured with regular or also deliberately controllable properties throughout.

In this respect it is important that the curtain of threads is moist throughout after leaving the precipitation bath up to the formation of the spunlaid fabric, i.e., is surrounded by a film of liquid. If the film of liquid is interrupted in one place this can lead to the separation of the curtain of threads into individual strands as a result of the formation of drops which takes place. In this respect it is by all means possible to subject the curtain of threads to different liquids one after the other.

In a preferred embodiment the process in accordance with the invention is designed so that the curtain of threads is kept under tension on the second conveyor device. This can be achieved via a mechanical draw-off device arranged on the second conveyor device, e.g. a roll.

In a preferred embodiment the curtain of threads is hydraulically kept under tension on the second conveyor device. To this end the curtain of threads can for example be sprayed with e.g. precipitation liquid in the upper part of the second conveyor device by means of nozzles.

In a preferred embodiment at least one of the conveyor devices is designed as a conveyor belt. Preference is given to at least one of the conveyor devices being designed as a screen belt. The third conveyor device can for example also be designed as a roll on which the spunlaid fabric is drawn off.

The second conveyor device is preferably designed as a plane inclined downhill. In this case the second conveyor device acts as a kind of slide across which the curtain of threads is led to the third conveyor device under the influence of liquid or via mechanical tension.

The formation of spunlaid fabric between the second and the third conveyor device can thereby be influenced by the inclination of the second conveyor device (e.g. the downhill inclined plane) by the establishment of a pool of liquid after the second conveyor device and by the way the liquid is removed.

Thus the inclination of the second conveyor device should preferably equal 10° to 30° since the regularity of the formed spunlaid fabric deteriorates if the inclination is greater or smaller. If liquid is applied to the second conveyor device, to keep the curtain of threads hydraulically under tension, it should be observed that the amount of liquid selected should not be too big. In this case the excess liquid when the spunlaid fabric forms on the third conveyor device causes a deterioration in the regularity of the formed spunlaid fabric. Moreover, it is preferable to increase the amount of liquid applied to the second conveyor device (e.g. the plane inclined downhill) with a rising throughput of the spinning solution through the orifices of the spinneret.

If the speed in the third conveyor device is higher the mass per unit area of the formed spunlaid fabric declines and the laid filament coils get bigger.

Furthermore, it proves to be an advantage to allow a pool of liquid of a defined length to form after the second conveyor device. This can for example be 100 mm long. To achieve a defined limit for the pool of liquid a vacuum suction box can be arranged below the third conveyor device.

The formed spunlaid fabric can be further treated in the well known way. In particular it is possible to bond the spunlaid fabric using water jets for example.

One further preferred embodiment of the invention is characterised in that the curtain of threads on the second conveyor device is exposed to a stream of a bonding agent. The spunlaid fabric containing bonding agent which forms in this respect can be bonded in the well known way following the formation of the spunlaid fabric for example using a thermal treatment.

In another preferred embodiment of the invention the curtain of threads is led via several second conveyor devices arranged one behind the other in the transport direction. In this way the regularity of the formed spunlaid fabric can be increased particularly when a downhill inclined plane is foreseen as the second conveyor device.

The process in accordance with the invention can be modified in a very flexible way by separating the process steps for the spinning of the filaments and the formation of the spunlaid fabric.

One further preferred embodiment of the process in accordance with the invention is therefore characterised in that filaments of different origin as the case may be are extruded through several spinnerets arranged diagonal to the transport direction of the curtain of threads and/or one behind the other in the transport direction, the extruded filaments are piled down on one or several first conveyor devices and the curtains of threads formed are united to one sole curtain of threads respectively spunlaid fabric either before, during or after the passing of the second conveyor device or as the case may be several second conveyor devices arranged diagonal to the transport direction and/or one behind the other in the transport direction.

This embodiment allows the skilled artisan to process pluralities of filaments of different origin in one step to a spunlaid fabric. By filaments of different origin we mean the following:

Filaments which are extruded from cellulose solutions which differ for example with regard to the concentration and/or type of the cellulosic material (type of pulp, cellulose derivatives . . . )

Filaments which are formed from polymers other than cellulose

Filaments with different fibre diameters (titre) or fibre cross-sections

However, several curtains of threads can also be individually formed from filaments of the same origin and not blended with each other until a later stage, e.g. on the second conveyor device.

In the case of filaments of different origin these can be spun using spinnerets arranged for example one next to the other and for example deposited on a single conveyor belt whereby a curtain of threads is produced with a blend of different filaments.

A plurality of filaments can, however, also be extruded using a spinneret and placed on one already existing curtain of threads of filaments of the same or different origin. In the same way it is possible to lead several curtains of threads on several first conveyor devices to one sole second conveyor device.

It is very easy for the skilled artisan to influence the place and the type of blending of filaments of the same or different origin by arranging the spinnerets and the conveyor devices in a corresponding manner and thus to influence the properties of the spunlaid fabric. In this way the properties of the spunlaid fabric can be controlled across a wide range.

One further possibility to influence the properties of the spunlaid fabric manufactured in accordance with the invention is that foreign matter is added to the curtain respectively the curtains of threads respectively to the formed spunlaid fabric on one of the conveyor devices.

By foreign matter for the purpose of the present invention we understand a material which is not formed in situ when carrying out the process according to the invention but rather which can be added to the curtains of threads respectively the formed spunlaid fabric already in a finished state. The foreign matter can be added to the curtain or curtains of threads respectively the formed spunlaid fabric for example on the first conveyor device before transferring to the second conveyor device, on the second conveyor device and/or on the third conveyor device.

The foreign matter can be in the form of fibres, powders and/or fibre structures. For example a fibre structure, a spunlaid fabric of cellulosic fibres or fibres of other polymers can be added.

The invention relates accordingly to a spunlaid fabric containing solvent-spun cellulosic fibres obtainable by extruding several pluralities of filaments as the case may be of different origin and the uniting of these to a curtain of threads respectively to a spunlaid fabric and/or the admixture of fibres respectively fibre structures on the second conveyor device. A spunlaid fabric of this kind in which a mixture of different cellulosic and/or non-cellulosic materials is already accomplished at a very early stage of the formation of spunlaid fabric, is new and differs in its properties from spunlaid fabrics to which foreign matter is added only after the formation of spunlaid fabric respectively the bonding of spunlaid fabric.

The spunlaid fabric according to the invention, as described above, is manufactured in a wide range of blending possibilities and blending ratios.

To carry out the process in accordance with the invention a device is used, which comprises:

At least one spinneret with orifices,

At least one precipitation bath arranged underneath the spinneret at a distance from the orifices, Agents, particularly cylinders, to stretch the filaments extruded by the spinneret in the air gap, At least one first conveyor device to form and transport a curtain of threads from the extruded filaments which is arranged at least partly in the precipitation bath preferably leading upwards out of the precipitation bath, at least one second downhill inclined conveyor device which is arranged directly after the first conveyor device, at least one third conveyor device which is arranged directly after the second conveyor device The first and the third conveyor device are preferably designed as conveyor belts. The second conveyor device is also preferably designed as a plane inclined downhill.

Other preferred characteristics of the process in accordance with the invention and the device in accordance with the invention are derived from the following description of the figures. The invention is hereby not limited to the embodiments depicted but encompasses other alternatives and other combinations of the elements depicted.

DETAILED DESCRIPTION OF THE INVENTION

Figure 1:
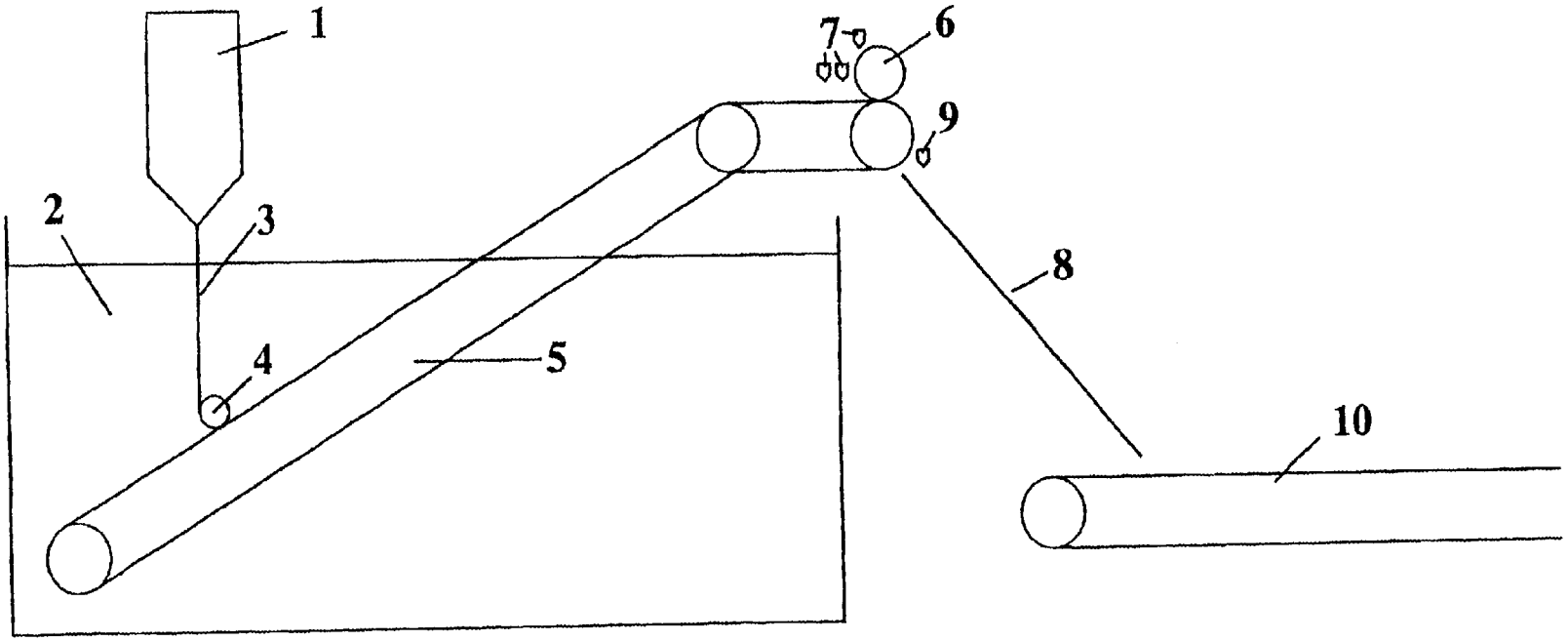
FIG. 1 depicts a device and process according to the invention wherein cellulosic fibres 3 extruded from spinneret 1 are laid onto first conveyor device 5 and then carried to downward sloping conveyor device 8 and drawn off by third conveyor device 10.

Number 1 designates a spinneret to extrude a cellulose solution in NMMO. Spinneret 1 can for example have approximately 50,000 orifices which are staggered one behind the other in 32 parallel rows and which thereby basically form altogether a rectangle (not shown). A vessel 2 is arranged below spinneret 1 which is filled with a liquid which precipitates the cellulose, e.g. water. A deflection organ 4 is located in vessel 2 which joins the extruded filaments 3 to a curtain of threads as the case may be and which deflects these to the first conveyor device 5.

A first conveyor device designed as a screen belt 5 is furthermore arranged in vessel 2 which leads at an incline upwards out of the vessel. Screen belt 5 has rolls 6 at the upper end. The rolls 6 stretch the extruded filaments 3 in the air gap between spinneret 1 and the precipitation bath surface. Moreover, rolls 6 can be used to press the curtain of threads. Means can be arranged above screen belt 5 off side of vessel 2, e.g. nozzles 7, to apply liquid to the curtain of threads.

Directly after screen belt 5 a conveyor device is arranged designed in the form of a downhill inclined plane 8. Plane 8 comprises a smooth material and is inclined at an angle of 10° to 30° to the horizontal direction. Nozzles 9 are arranged above plane 8 to apply liquid to the curtain of threads.

Directly at the lower end of plane 8 there is a third conveyor device designed as a screen belt 10. Different devices for the further treatment of the formed spunlaid fabric can be arranged along screen belt 10 such as for example a facility to add a fibre structure to the spunlaid fabric, means to apply liquid to the spunlaid fabric, a device to bond the spunlaid fabric and facilities to wash the spunlaid fabric. Moreover, at a certain distance from the place which plane 8 borders with screen belt 10 a vacuum suction box (not shown) can be arranged to control the size of the pool of liquid which forms. At the end of screen belt 10 there is a device (not shown) to wind up the finished spunlaid fabric.

The mode of operation of the process in accordance with the invention is described in the following on the basis of the figure:

A plurality of filaments 3 is extruded from spinneret 1 which is led across an air gap between spinneret 1 and the surface of the precipitation bath and stretched in this air gap using roller pair 6. The plurality of filaments is laid down on screen belt 5 after entering the precipitation bath via deflection organ 4 whereby a curtain of threads forms of what are filaments arranged basically in parallel fashion. The curtain of threads is led upwards out of vessel 2 on screen belt 5 at a speed of e.g. 1 to 200 m/min, pressed with roll pair 6 if necessary and led to plane 8.

At plane 8 the curtain of threads slides downwards onto screen belt 10. By means of applying liquid jets, e.g. jets of water from nozzle 9, the curtain of threads is kept under tension on plane 8. At the lower end of plane 8 the curtain of threads is suspended since the speed of screen belt 10 (typically 1 to 100 m/min) is less than the speed at which the curtain of threads at the level slides downwards. The spunlaid fabric forms here.

The formed spunlaid fabric is now further transported on screen belt 10 and if necessary treated in the facilities for further treatment described above, washed and wound up.

At all of these stages it is made sure for example by using nozzles 7 respectively 9 that the curtain of threads is moist throughout.

Figure 2:
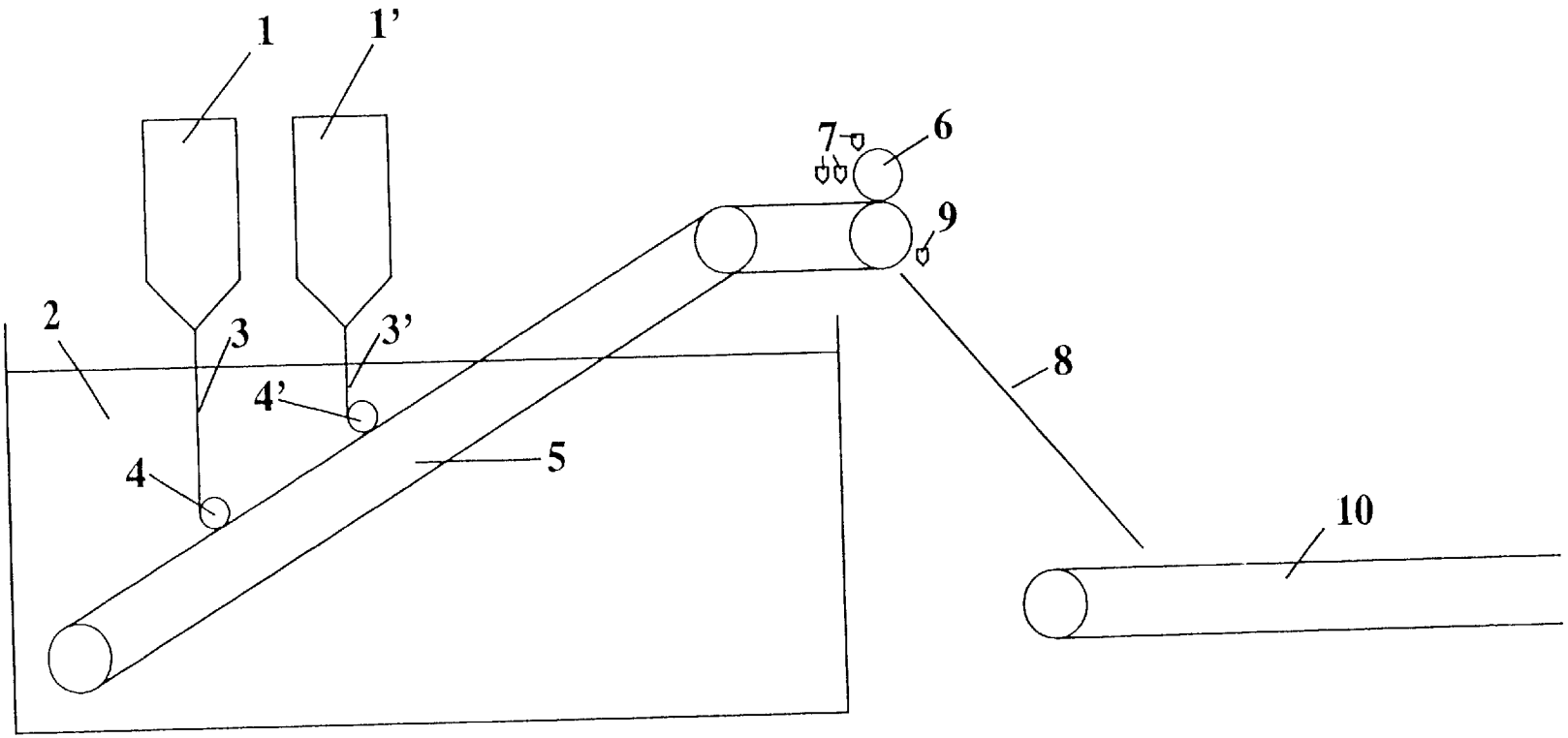
FIG. 2 depicts a device and process according to the invention similar to that depicted in FIG. 1, except that cellulosic fibres 3 and 3' are extruded from two spinnerets, 1 and 1', respectively, and laid onto first conveyor device 5.

FIG. 2 gives a schematic depiction of one further embodiment of the process in accordance with the invention in which two spinnerets 1, 1' are arranged above vessel 2. Pluralities of filaments 3, 3' of the same or of a different origin are extruded from these two spinnerets. Both pluralities of filaments 3, 3' are deposited on screen belt 5 via the respective deflection organs 4, 4' whereby the plurality of filaments extruded from spinneret 1' is deposited on a curtain of threads which already exists and comprises filaments 3 from spinneret 1. A spunlaid fabric is thereby created with a blend of the families of filaments extruded from both spinnerets 1, 1'.

Figure 3:
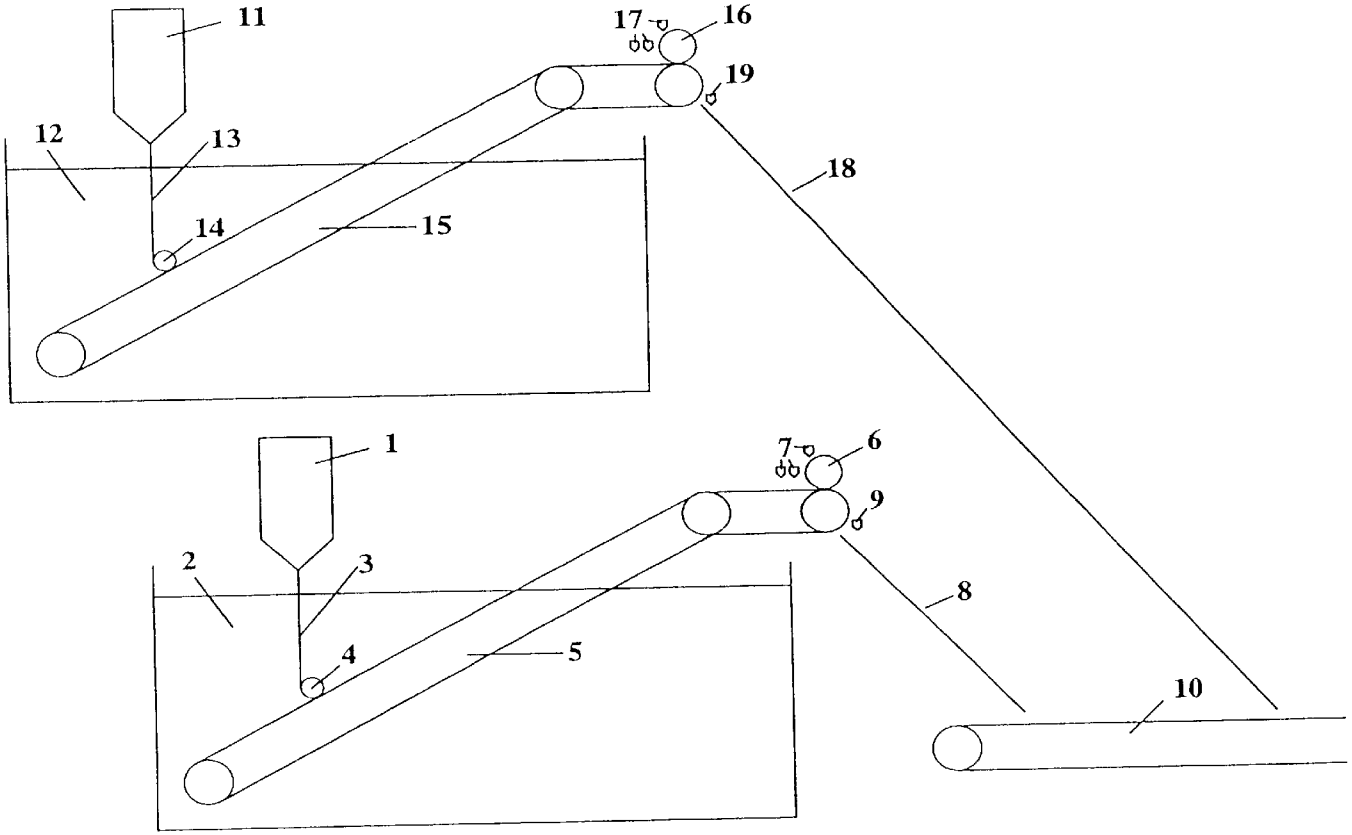
FIG. 3 depicts a device and process according to the invention wherein two spinnerets, 1 and 11, extrude cellulosic fibres 3 and 13, respectively, which are laid onto separate first conveyors 5 and 15 which then carry the fibres to separate second, downward-sloping conveyors 8 and 18, after which they are drawn off by shared third conveyor 10.

FIG. 3 shows one more embodiment of the process in accordance with the invention in which first of all in two separate devices two pluralities of filaments 3, 13 as the case may be of different origin are deposited on two first conveyor devices 5, 15 from the respective two spinnerets 1, 11 and are transported downwards via slides 8, 18. In FIG. 3 other components with the same effect are designated with the same reference characters in the final position (e.g. 6, 16).

However, only one screen belt 10 is foreseen as the third conveyor device on which one after the other the curtain of threads slides from slide 8 and finally the curtain of threads from slide 18. Each time that the each curtain of threads enter into contact with screen belt 10, a spunlaid fabric forms. All in all this results in a spunlaid fabric from an intimate blend of filaments as the case may be of different origin.

Figure 4:
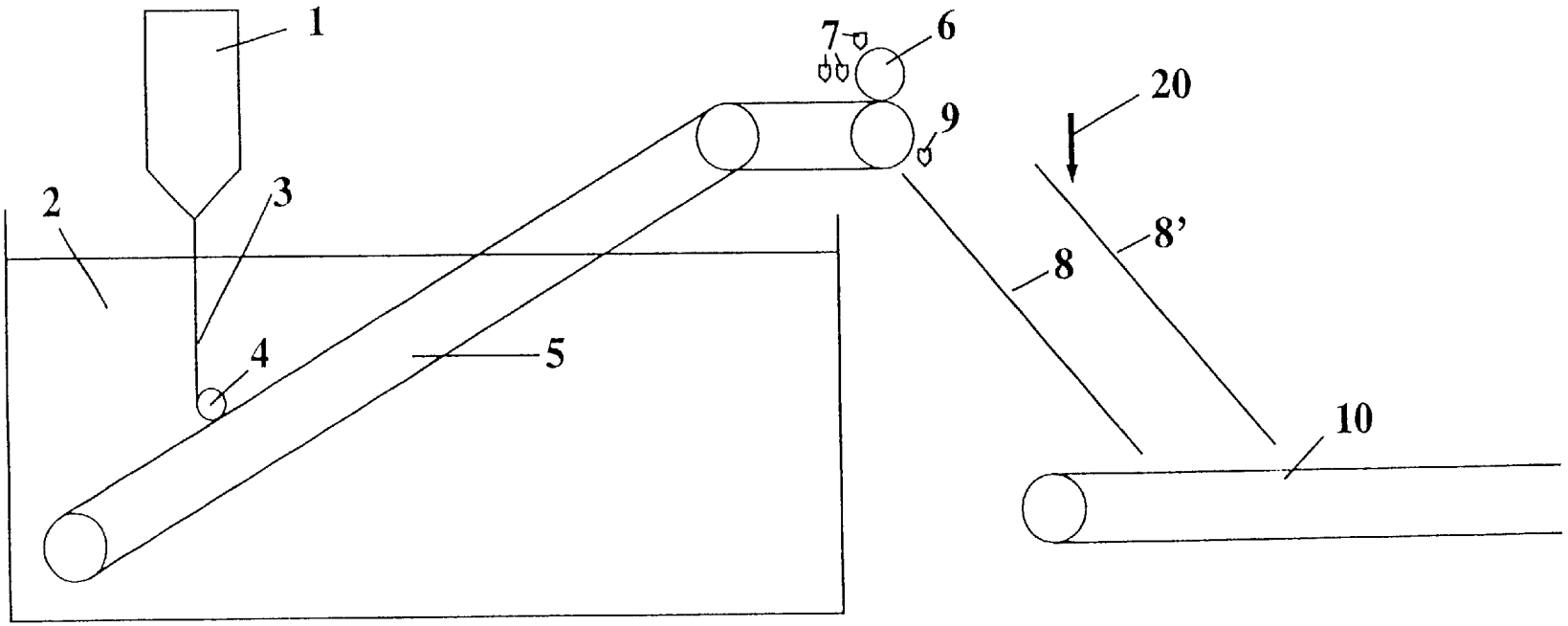
FIG. 4 depicts a method and process according to the invention wherein in addition to the device and process of FIG. 1, foreign matter provided by device 20 is conveyed via sloping conveyor 8' to admix with fabric carried by conveyor 10.

In addition to the device depicted in FIG. 1, FIG. 4 also depicts a device 20 for the admixture of foreign matter, e.g. in the form of a spunlaid fabric. In the embodiment depicted in FIG. 4 the foreign matter is admixed via device 20 to the super-bonded fabric which has already formed on the third conveyor device 10 via a downhill inclined plane 8'. It is, however, also possible to admix the foreign matter via device 20 to the curtain of threads at plane 8 or before plane 8, e.g. on screen belt 5. In the same way in the case of the use of several second conveyor devices arranged one behind the other, e.g. levels inclined downhill, it is possible to admix the foreign material between two levels.

EXAMPLES

Example 1

On a device in accordance with FIG. 1 a spinning solution was extruded with 13 weight percentage of cellulose via a spinneret with 12150 orifices (100 $\mu$m diameter) with an extrusion rate of 0.025 g spinning solution/orifice/minute into an aqueous spinning bath with 2% of NMMO. The extruded filaments with a titre of respectively 1.7 dtex were deposited on a first screen belt to a curtain of threads and transported out of the spinning bath at a speed of 23 m/min. The curtain of threads was suspended downwards directly after the first screen belt via a slide whereby 4 m3/h of water were applied from a slot die onto the curtain of threads on the slide. At the lower end of the slide the curtain of threads was suspended on to a second screen belt which had a speed of 5.6 m/min. At this stage the spunlaid fabric was formed. Using a vacuum suction box, which was arranged below the second screen belt, the size of the pool of liquid was controlled.

This resulted in an evenly laid spunlaid fabric with a basis weight of 22 g/m2.

Example 2

The procedure was the same as in example 1 whereby however filaments were manufactured with an individual titre of 1.3 dtex, the speed of the first screen belt equalled 30.2 m/min and the speed of the second screen belt was 7.3 m/min.

The result was an evenly laid spunlaid fabric with a basis weight of 23 g/m$^2$.

Example 3

The procedure was the same as in example 1 whereby however filaments were manufactured with an individual titre of 3.5 dtex, the speed of the first screen belt equalled 24 m/min, the speed of the second screen belt 2.5 m/min and the amount of liquid led to the slide 2.5 m$^3$/h.

This resulted in an evenly laid spunlaid fabric with a basis weight of 255 g/m$^2$.

Example 4

The procedure was the same as in example 1 whereby however the speed of the first screen belt equalled 23 m/min, the speed of the second screen belt 2.7 m/min and the liquid amount led to the slide equalled 3 m$^3$/h.

This resulted in an evenly laid spunlaid fabric with a basis weight of 60 g/m$^2$.

Example 5

The procedure was the same as in example 1 whereby however filaments were manufactured with an individual titre of 3.3 dtex, the speed of the first screen belt equalled 11.6 m/min, the speed of the second screen belt 1.4 m/min and the liquid amount led to the slide equalled 1 m$^3$/h.

This resulted in an evenly laid spunlaid fabric with a basis weight of 138 g/m$^2$.

We claim:

1. A process for the production of a spunlaid fabric containing solvent-spun cellulosic fibres comprising the steps of (i) extruding a solution of cellulose in an aqueous tertiary amine oxide via a spinneret with orifices to form extruded filaments; (ii) stretching the extruded filaments in an air gap; (iii) leading the extruded filaments into a precipitation bath; (iv) intercepting the extruded filaments in the precipitation bath by a first conveyor device; (v) forming a curtain of threads comprised of filaments essentially oriented parallel to each other and essentially of constant thickness on the first conveyor device; (vi) transporting the curtain of threads out of the precipitation bath using the first conveyor device onto a second conveyor device inclined downhill; (vii) transporting the curtain of threads on the second conveyor device onto a third conveyor device; and (viii) drawing off the curtain of threads, using the third conveyor device, at a speed less than the speed of the curtain of threads transported downwards on the second conveyor device, such that a spunlaid fabric is formed on the third conveyor device.

2. The process according to claim 1 wherein the curtain of threads is kept under tension on the second conveyor device.

3. The process according to claim 2 wherein the curtain of threads is kept under tension by a mechanical draw-off device arranged on the second conveyor device.

4. The process according to one of claim 2 or 3 wherein the curtain of threads on the second conveyor device is hydraulically kept under tension.

5. The process according to claim 1 wherein at least one of the conveyor devices is designed as a conveyor belt.

6. The process according to claim 1 wherein the second conveyor device is designed as a plane inclined downwards.

7. The process according to claim 1 wherein one or both of the group consisting of the first conveyor device and the third conveyor device is designed as a screen belt.

8. The process according to claim 1 wherein the curtain of threads on the second conveyor device is exposed to a stream of bonding agent.

9. The process according to claim 1 wherein the curtain of threads is led via several second conveyor devices arranged one behind the other in the transport direction.

10. The process according to claim 1 wherein filaments of different origin are extruded through several spinnerets arranged in an orientation selected from the group consisting of diagonal to the transport direction of the curtain of threads, one behind the other in the transport direction, and a combination thereof, the extruded filaments are piled down on one or several first conveyor devices and the curtains of threads formed are united to form one sole curtain of threads or spunlaid fabric either before, during or after passing the second conveyor device or several second conveyor devices arranged in an orientation selected from the group consisting of diagonal to the transport direction, one behind the other in the transport direction, and a combination thereof.

11. The process according to claim 1 comprising a step wherein foreign matter is added to a member of the group consisting essentially of a curtain of threads and a formed spunlaid fabric on one of the conveyor devices.

12. The process according to claim 11 wherein the foreign matter can be in a form selected from the group consisting of fibres, powder and fibre structures.

13. The process according to claim 12 wherein the fibre structure is a spunlaid fabric comprised of components selected from the group consisting of cellulosic fibres and fibres of other polymers.

* * * * *